US005127511A

United States Patent [19]

Keen, Jr. et al.

[11] Patent Number: 5,127,511

[45] Date of Patent: Jul. 7, 1992

[54] METHODS AND APPARATUS FOR FEEDING AND ASSEMBLING CYLINDRICAL ARTICLES FROM BULK AT HIGH SPEED

[75] Inventors: Billy J. Keen, Jr., Chesterfield; Richard B. Reich; George R. Scott, both of Midlothian, all of Va.

[73] Assignee: Philip Morris Incorporated, New York, N.Y.

[21] Appl. No.: 648,909

[22] Filed: Jan. 31, 1991

[51] Int. Cl.[5] ..... B65G 47/31

[52] U.S. Cl. ..... 198/461; 198/689.1; 198/396

[58] Field of Search ..... 198/689.1, 461, 443, 198/803.5, 478.1, 396

[56] References Cited

U.S. PATENT DOCUMENTS

| | | | |
|---|---|---|---|
| 3,323,633 | 6/1967 | Engel et al. | 198/455 |
| 3,608,697 | 9/1971 | Wahle et al. | 198/689.1 X |
| 3,640,373 | 2/1972 | Seragnoli | 198/443 X |
| 3,721,330 | 3/1973 | Crawford et al. | 198/461 |
| 3,868,013 | 2/1975 | Brackmann et al. | 198/392 |
| 3,978,969 | 9/1976 | Williams et al. | 198/461 |
| 4,006,812 | 2/1977 | Everett et al. | 198/347 |
| 4,079,831 | 3/1978 | Greider | 198/396 |
| 4,138,009 | 2/1979 | Strong | 198/396 |
| 4,197,935 | 4/1980 | Aterianus et al. | 198/461 X |
| 4,296,660 | 10/1981 | Cristiani | 83/100 |
| 4,369,875 | 1/1983 | Schmitz | 198/456 |
| 4,514,963 | 5/1985 | Bruno | 53/493 |
| 4,645,069 | 2/1987 | Sjogren | 198/689.1 |
| 4,717,013 | 1/1988 | Reissmann et al. | 198/461 |
| 4,815,581 | 3/1989 | Deutschlander | 198/461 |
| 4,863,154 | 9/1989 | Hirakawa et al. | 271/176 |
| 4,938,340 | 7/1990 | Horsley et al. | 198/462 |

FOREIGN PATENT DOCUMENTS

| | | | |
|---|---|---|---|
| 0211209 | 9/1986 | Japan | 198/689.1 |

*Primary Examiner*—Robert P. Olszewski
*Assistant Examiner*—James R. Bidwell
*Attorney, Agent, or Firm*—Nicola A. Pisano

[57] ABSTRACT

Methods and apparatus are provided for sorting and transporting cylindrical articles from a jumbled mass into a continuous stream of uniformly spaced articles aligned end-to-end. The methods include the steps of sorting, spacing and incorporating the spaced apart articles into component assemblies. The invention apparatus comprises a bowl feeder, a series of frictional, suction and lugged belt conveyors and a plurality of vacuum transfer and assembly drums. The apparatus includes a plurality of sensors, a control system and transmission systems for regulating the sorting and transfer of the articles, for synchronizing transfer of the articles between apparatus subsystems, and for incorporating the articles into component assemblies.

26 Claims, 6 Drawing Sheets

20
10
17
3
3
34
30
41
4
4
42
43
40
A
41
B
60
71
70
90
72
81
5
91
82
80
81
83
5
101
6
6
7
7
140
120
110
100
160
150
50

METHODS AND APPARATUS FOR FEEDING AND ASSEMBLING CYLINDRICAL ARTICLES FROM BULK AT HIGH SPEED

BACKGROUND OF THE INVENTION

1. Field Of The Invention

This invention relates to the high speed transfer of cylindrical articles from a jumbled mass at a bulk inlet to a stream of articles aligned end-to-end and having uniform spacing. The articles are then transferred by a series of vacuum transfer drums to an assembly drum, where they are joined with other components.

In particular, the present apparatus, comprising a bowl feeder and a series of belt conveyors, is designed to sort relatively frail carbon rods and to present the carbon rods in an end-to-end uniformly spaced stream for incorporation into a smoking article, such as that described in commonly assigned copending U.S. application Ser. No. 315,822. These carbon rods are relatively small objects, about one-half inch long and one-eighth inch in diameter. Special consideration was given in designing the apparatus of the present invention so as to maintain the structural integrity of the carbon rods, which are strongest under axial compressive loads.

2. Prior Art

The use of bowl feeders to unsort a jumbled mass of articles is well known, and is described for example in Brackmann et al. U.S. Pat. No. 3,868,013 and Schmitz U.S. Pat. No. 4,369,875. Brackmann U.S. Pat. No. 3,868,013 describes the use of centrifugal forces created by rotation of the bowl to displace the articles into a groove along the periphery of the bowl. Schmitz U.S. Pat. No. 4,369,875 describes the use of a spiral sidewall disposed above a rotating mat, so that articles placed on the mat are guided by the sidewall into a continuous stream aligned end-to-end. The result of both of the above bowl feeders is to achieve a stream of articles aligned end-to-end at the exit of the bowl feeder. The present invention includes a centrifugal bowl feeder similar to that described in Brackmann et al. U.S. Pat. No. 3,868,013.

The use of a series of belt conveyors to transport cylindrically spaced-apart articles is also well known. Such conveyor systems are shown in Engel U.S. Pat. No. 3,323,633, Williams et al. U.S. Pat. No. 3,978,969 and Cristiani U.S. Pat. No. 4,296,660. A number of methods are used to achieve a grip on the article to be transported so as to permit its forward displacement along the belt conveyor. Engel U.S. Pat. No. 3,323,633, relies on frictional forces between the articles and the belt conveyor, created by the weight of the articles, to achieve a grip on the articles transported. Williams et al. U.S. Pat. No. 3,978,969, shows the use of opposing belts where some slippage between the article and the belts is desired and the use of a lugged belt where positive engagement between the belt and article is required. Cristiani U.S. Pat. No. 4,296,660 shows the use of a suction belt conveyor to maintain a desired relationship between articles carried on the belt surface.

Williams et al. U.S. Pat. No. 3,978,969 describes an arrangement of smooth and lugged belt conveyors that can be used to achieve acceleration and spacing of articles along the length of the belts. A disadvantage of this system, noted in that patent, is the inability of the system to achieve uniform spacing of the articles. Instead, a lugged timing wheel is provided specifically to regulate the spacing of the articles.

In view of the foregoing, it is an object of the present invention to provide a method and apparatus for sorting and transporting articles at uniform intervals without the use of a timing wheel and associated mechanisms.

It is another object of this invention to provide a method and apparatus for sorting and transporting articles at uniform intervals wherein uniform spacing is achieved by the arrangement and synchronization of the belt conveyor system components.

It is still another object of this invention to provide a high speed system for feeding cylindrical articles which is able to smooth out fluctuations in the stream of articles exiting a bowl feeder so that a continuous stream of uniformly spaced articles is provided at the transfer point of the feed system.

It is yet another object of this invention to provide a high speed transfer system which permits the sorting and transfer of small, fragile, cylindrical articles, with a minimum of breakage.

It is another object of this invention to provide a method and apparatus for assembling a stream of carbon rods into smoking article components at high speed.

SUMMARY OF THE INVENTION

The present invention provides methods for using a combination, including a bowl feeder and frictional, suction and lugged belt conveyors, to obtain a stream of uniformly spaced article from a jumbled mass. The methods further include steps for incorporating the resulting stream of spaced articles into smoking article components using a series of vacuum transfer and assembly drums.

The apparatus of the present invention comprises a sorting and transport system for cylindrical articles wherein the articles are deposited in a bowl feeder in a mass and sorted by the bowl feeder into a stream of articles aligned end-to-end. The stream of articles exiting the bowl feeder is transferred to a first belt conveyor, which belt conveyor serves as a reservoir of articles to smooth out fluctuations in the delivery of articles from the bowl feeder.

A second suction belt conveyor, operating at about one-half the speed of the first belt conveyor, regulates the forward displacement of articles from the first belt conveyor to the proximal end of an isolation guideway. Articles deposited on the isolation guideway are urged toward the distal end of the guideway by the line of articles accumulating at the proximal end from the second suction belt conveyor.

A third suction belt conveyor disposed near the distal end of the isolation guideway engages the articles urged across the isolation guideway. The third belt conveyor accelerates the articles as it engages them, thereby spacing the articles carried by the third belt conveyor at uniform intervals.

A fourth lugged belt conveyor strips the articles from the third belt conveyor, so that the articles register against the lugs.

These articles are in turn stripped from the fourth lugged belt conveyor by a rotating drum having a plurality of vacuum pockets. Articles gripped by the vacuum pockets of the rotating drum are rotated 90 degrees and transferred first to a transfer drum and then to a smoking article component assembly drum. A slide block mechanism incorporates the articles into a completed smoking article component, such as that described in the above-mentioned U.S. application Ser. No. 315,822.

The apparatus includes control systems to monitor the quantity of articles accumulating in the bowl feeder and in the first belt conveyor reservoir, as well as a system to adjust the synchronization of the second and third belt conveyors.

Further features of the invention, its nature and various advantages will be more apparent from the accompanying drawings and the following detailed description of the preferred embodiments.

DETAILED DESCRIPTION OF THE PREFERRED EMBODIMENTS

The method and apparatus of the present invention are described with reference to the sorting, transport and assembly of cylindrical articles such as the carbon rods incorporated in the smoking article described in above-mentioned U.S. application Ser. No. 315,822. It is to be understood that the methods and apparatus for the invention have wide application to transport and assembly systems for cylindrical articles. With respect to the present application to smoking articles, these cylindrical articles are referred to hereinafter as "carbon rods."

The method of feeding and assembly carbon rods of the present invention comprises a first step of sorting a jumbled mass of carbon rods deposited in a bowl feeder; separating the carbon rods into a stream aligned end-to-end; slidably engaging the carbon rods exiting the bowl feeder with a covered belt conveyor to form a reservoir of carbon rods aligned end-to-end; decelerating the carbon rods transferred onto the covered belt conveyor with a first suction belt conveyor; transferring the carbon rods from the first suction belt conveyor to the proximal end of an isolation guideway; urging the carbon rods transferred to the isolation guideway from the proximal to the distal end of the guideway; accelerating the forwardmost carbon rod at the distal end of the isolation guideway by engaging it with a second suction belt conveyor; and stripping the carbon rod from the second suction belt conveyor with a lugged suction belt conveyor. The carbon rod is then transferred to a vacuum drum, across a transfer drum, and to a smoking article assembly drum, where it is incorporated into a smoking article component.

Figure 1:
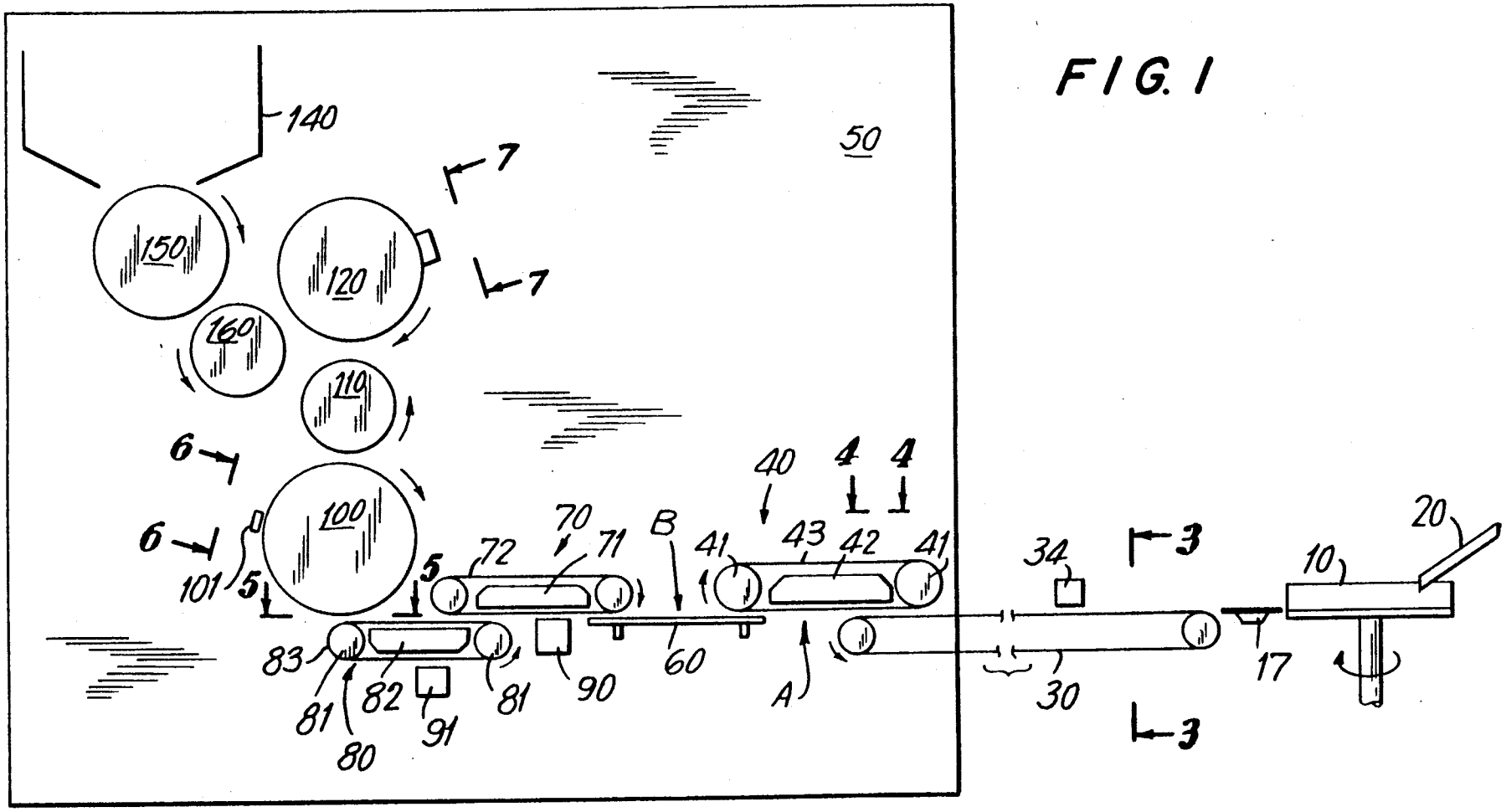
FIG. 1 is a an elevation plan view of an illustrative embodiment of the apparatus of the present invention.
Figure 2:
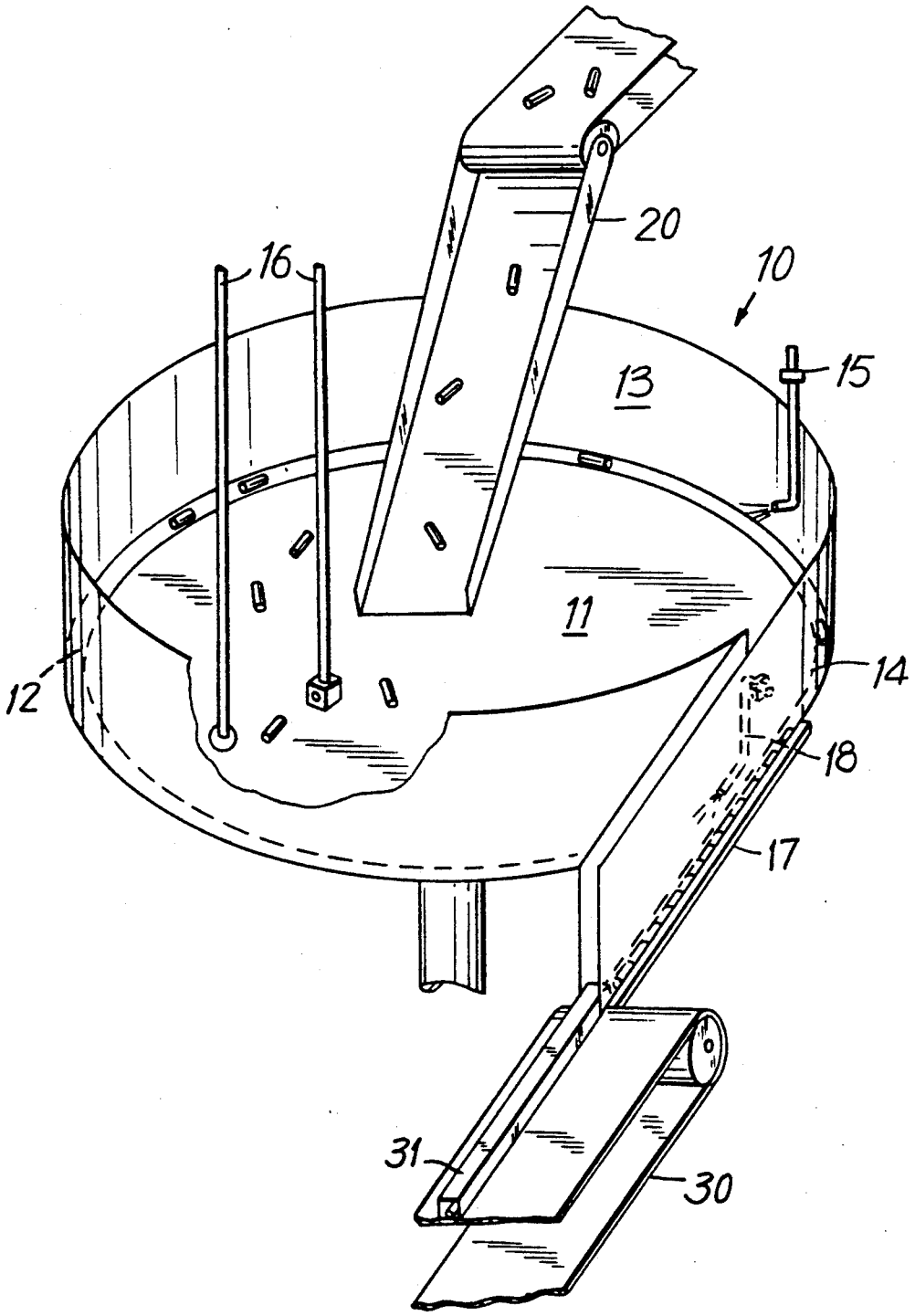
FIG. 2 is a fragmentary perspective view of the bowl feeder of the apparatus of the present invention.

Referring to FIGS. 1 and 2, an apparatus illustrating the inventive principles of the present invention is described. The apparatus comprises bowl feeder 10, a series of accelerating and decelerating belt conveyors, and transfer and assembly drums. Carbon rods are received from a pre-feed hopper (not shown) and sifted to remove any fragments. The carbon rods are then fed as a mass down chute 20 into bowl feeder 10 having rotating mat 11, which mat 11 centrifugally displaces the carbon rods onto rotating rim 12 of bowl feeder 10. Bowl feeder 10 has a vertical sidewall 13 disposed in close fitting relation above rotating rim 12, to retain the carbon rods within the bowl feeder. Rim 12 rotates at a slightly greater speed than rotating mat 11.

Rim 12 varies in width from several carbon rod thicknesses to a single carbon rod thickness at its narrowest point. The variation in thickness of rim 12 is designed to induce carbon rods to stack up several rows deep parallel to sidewall 13, from which the innermost rows are successively dropped off, thereby assuring that the carbon rods have the desired orientation parallel to sidewall 13. This action is further enhanced by tilting the axis of rotation of mat 11 slightly from the vertical, so that the carbon rods can be centrifugally displaced onto rotating rim 12 only at its widest point. Consequently, rim 12 creates a shelf at all other points of contact with mat 11. Carbon rods which are standing on end are knocked off rim 12 by air jet 15. At the point at which the stream of carbon rods resting against sidewall 13 is narrowed to a single carbon rod width, it passes between fence 14 and sidewall 13 and is channeled out of bowl feeder 10.

Bowl feeders as just described are per se known, such as the Model RD, Series 30 Centrifugal Feeder manufactured by Hoppman Corp., Chantilly VA. As is typical, the manufacturer provides the bowl and rotating mat, and the product user designs a sidewall and fence arrangement adapted for the specific application.

The stream of end-to-end aligned carbon rods exits bowl feeder 10 through a channel created by sidewall 13 and fence 14. The stream of carbon rods is directed onto the proximal edge of a short rigid plate 17. The line of carbon rods is urged toward the distal edge of plate 17 by those accumulating to the rear on rim 12. Air jet 18 disposed between sidewall 13 and fence 14 further assists movement of the carbon rods across plate 17.

Figure 3:
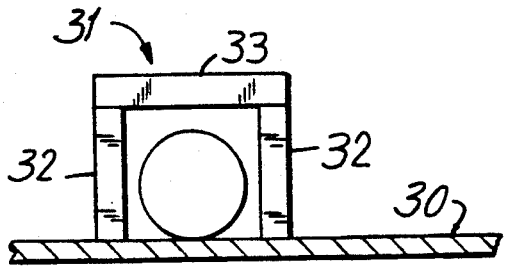
FIG. 3 is a sectional view of the first belt conveyor hood taken along the line 3—3 of FIG. 1.

At the distal edge of plate 17, the line of carbon rods passes onto the upper flight of covered belt conveyor 30, which belt conveyor is moving slightly faster than rotating rim 12. Covered belt conveyor 30 is comprised of conventional belt conveyor parts, including head and tail drums, intermediate rollers, drive means, support means, and a smooth elastomer impregnated belt, as is well known. Hood 31, comprised of two sidewalls 32 and a top 33, is disposed above and out of contact with the upper flight of belt conveyor 30. Hood 31 is designed to cover the carbon rods carried on belt conveyor 30, and thereby restrain lateral movement of the carbon rods. As shown in FIG. 3 the cross-sectional area enclosed by hood 31 is such that only one carbon rod can fit within it, thereby preventing two or more carbon rods from plugging the hood or stacking side-by-side.

The upper flight of covered belt conveyor 30 acts in conjunction with hood 31 to form a reservoir of carbon rods, wherein the carbon rods form a continuous stack aligned end-to-end. In the preferred embodiments, belt conveyor 30 is about six feet long, and is contemplated to carry a stack of axially aligned carbon rods about three feet in length. Accordingly, the smooth surface of belt conveyor 30 is designed to slip freely under the stack of carbon rods, without undue abrasion of the carbon rods or frictional heat generation. Because the stream of axially aligned carbon rods issuing from bowl feeder 10 fluctuates temporally, the length of the carbon rod stack varies accordingly.

Bowl feeder 10 has sensor 16 disposed within it near the exit of chute 20. Sensor 16, which may be, for example, a photoelectric cell, monitors the density of carbon rods in bowl feeder 10. Sensor 34, which also may be a photoelectric sensor, or other suitable type, is disposed in hood 31 at a distance of about three feet from the proximal end of belt conveyor 30. Sensor 34 monitors the length of the carbon rod stack within the reservoir portion of belt conveyor 30. Sensors 16 and 34 are connected to a logic circuit or switch, which continuously monitors their output signals. The switch or logic circuit maintains a near constant quantity of carbon rods in the reservoir portion of belt conveyor 30 and in bowl feeder 10.

For example, if sensor 34 senses that the carbon stack length on belt conveyor 30 exceeds the target length, it signals a cessation of carbon rod loading to chute 20 and activates air jet 15 to blow all of the carbon rods off rim 12. When the carbon rod stack length falls below the target length, as measured by sensor 34, feeding of carbon rods to chute 20 is resumed. If sensor 16 indicates that the quantity of carbon rods in bowl feeder 10 is too low, it signals for feeding of carbon rods to chute 20 at either a first speed or a second faster speed. Conversely, if sensor 16 signals that too many carbon rods have been loaded onto mat 11, it signals a cessation of carbon rod loading to chute 20. The switch or logic circuit and sensors 16 and 34 also prevent the carbon rods accumulating along belt conveyor 30 and plate 17 from backing up into bowl feeder 10.

Referring still to FIG. 1, carbon rods carried to the distal end of covered belt conveyor 30 are decelerated by braking belt conveyor 40. Braking belt conveyor 40 is mounted on vertically oriented support plate 50 so that a portion of its lower flight and proximal end are located in opposing fashion above the distal end of covered belt conveyor 30. The distal end of braking belt conveyor 40 is disposed above isolation guideway 60.

Braking belt conveyor 40 has two sprocket wheels 41 located at either end, a suction housing 42, and a geared belt 43. Sprocket wheels 41 and suction housing 42 are mounted on vertically oriented support plate 50. Suction housing 42 comprises an enclosure mounted on support plate 50, a vacuum fitting and a opening disposed adjacent to the rear surface of the lower flight of belt 43. Geared belt 43 is comprised of an elastomer impregnated material, as is conventional. A conventional vacuum source is connected to the vacuum fitting of suction housing 42, so as to draw suction through the opening in suction housing 42 located adjacent to the rear surface of the lower flight of belt 43.

Figure 4:
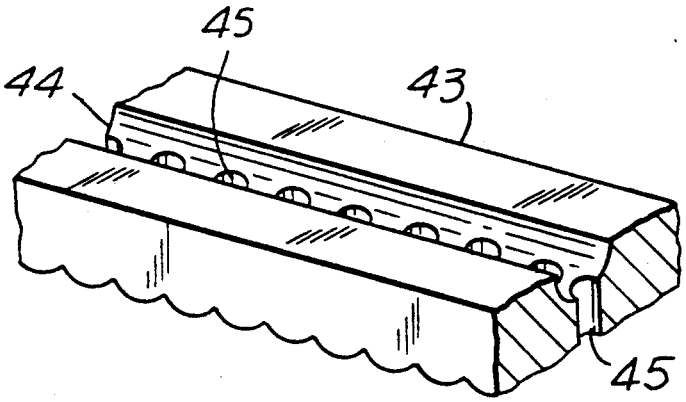
FIG. 4 is a fragmentary perspective view of an illustrative embodiment of the belt of the second belt conveyor taken along the line 4—4 of FIG. 1.

Belt 43 is configured to accept the articles to be transported. As shown in the illustrative embodiment of FIG. 4, belt 43 has radiused groove 44 along its midline. A line of apertures 45 is located along the centerline of groove 44, which apertures 45 extend through the belt thickness. When apertures 45 in belt 43 register with the proximal end of the opening in suction housing 42 (nearest bowl feeder 10), suction drawn through apertures 45 engages a carbon rod from atop covered belt conveyor 30 to the outward face of the lower flight of braking belt conveyor 40. Braking belt conveyor 40 operates at a speed about one-half that of covered belt conveyor 30, thereby slowing the progress of the line of carbon rods along covered belt conveyor 30, and causing them to stack up end-to-end in the reservoir portion of belt conveyor 30. The stacked up carbon rods advance along belt conveyor 30 at the speed of braking belt conveyor 40.

As the lower flight of belt 43 traverses from its proximal to its distal end, apertures 45 in belt 43 reach the distal end of the opening in suction housing 42 causing the suction engaging the carbon rod in groove 44 of belt 43 to cease. This occurs as the belt passes over the proximal end of isolation guideway 60, so that the carbon rod is deposited onto the proximal end of isolation guideway 60. Isolation guideway 60 comprises two parallel guide bars, a cover and support means for mounting the assembly on support plate 50. The guide bars and cover cooperate to maintain the carbon rods in end-to-end alignment. The stack of carbon rods on isolation guideway 60 advances towards the distal end of the guideway as new carbon rods are deposited at the proximal end by braking belt conveyor 40.

Acceleration belt conveyor 70 is mounted to support plate 50 and has its proximal end disposed above the distal end of isolation guideway 60 and its distal end disposed in opposing fashion above the proximal end of lugged belt conveyor 80. Belt conveyor 70 is also a suction belt conveyor, and is constructed substantially the same as braking belt conveyor 40, including the use of a suction housing 71 and an apertured grooved belt 72, like belt 43. Acceleration belt 70 operates at a speed about three times that of braking belt conveyor 40. When the lower flight of belt conveyor 70 grasps carbon rods from isolation guideway 60, it creates essentially uniform gaps between the carbon rods. This spacing is achieved by the difference in speeds between conveyor 70 and the line of carbon rods advancing on isolation guideway 60, and without the use of a timing wheel.

Figure 5:
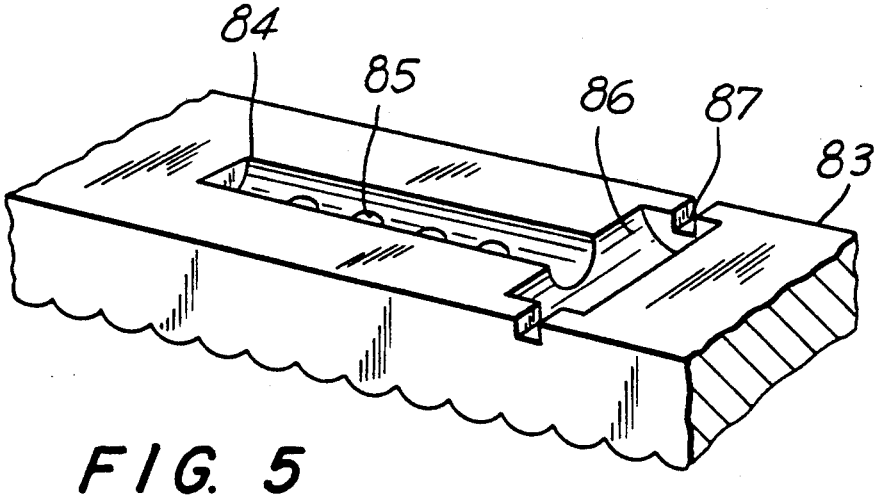
FIG. 5 is a fragmentary perspective view of an illustrative embodiment of the belt of the fourth belt conveyor taken along the line 5—5 of FIG. 1.

Lugged belt conveyor 80 is disposed in opposing fashion beneath the distal end of acceleration belt conveyor 70. Lugged belt conveyor 80 is also a suction belt, comprising sprocket wheels 81 mounted at either end on support plate 50, suction housing 82 having its opening directed upwardly towards the underside of the upper flight of belt conveyor 80, and geared lug belt 83. As shown by the illustrative embodiment in FIG. 5, lug belt 83 may have an intermittent groove 84 radiused to accept a carbon rod, which groove 84 has apertures 85 at its centerline similar to those of belt 43. Unlike belt 43 however, groove 84 terminates in an indentation lug 86 at its proximal end. Indentation lug 86, which forms the lug against which a carbon rod registers, has a square notch 87 in the portion forming the sidewalls of the indentation. The length of the apertured groove 84 associated with each lug position is about two and one-half to three times the length of the carbon rod.

In operation, when a carbon rod gripped by the lower flight of acceleration belt conveyor 70 passes beyond the distal end of the suction opening in suction enclosure 71, the vacuum holding the carbon rod to belt 72 is cut off. Simultaneously, the carbon rod, which is at this point located over the proximal end of lug belt conveyor 80, is drawn by suction from suction enclosure 82 into apertured groove 84 of lug belt 83. Once disposed in apertured groove 84 of belt 83, the carbon rod slides towards indentation lug 86 until the rear axial face of the carbon rod registers against the proximal edge of indentation lug 86. This backwards sliding motion between the carbon rod and belt 83 of lugged belt conveyor 80 is induced by the slightly faster operating speed of belt conveyor 83, which is about 25% faster than the speed of acceleration belt conveyor 70.

Carbon rods carried by acceleration belt conveyor 70 are known to have essentially uniform spacing, however, the precise location of any given carbon rod engaged by acceleration belt conveyor 70 is not known with sufficient precision to permit direct transfer of the carbon rods from acceleration belt conveyor 70 to vacuum transfer drum 100. Accordingly, transfer of the carbon rods from acceleration belt conveyor 70 to lugged belt 80, permits the carbon rods to register against indentation lugs 86, thereby better defining the precise location of the carbon rods.

Furthermore, while acceleration belt 70 has been observed to provide high precision in engaging the carbon rods from the isolation guideway and delivering them to the apertured grooves of lugged belt conveyor 80, the potential exists during long-term operation for some drift to arise in the synchronization of the two belts, for example, by differential stretching of belts 72 and 83. To remedy this concern, a control system is included to synchronize the delivery of carbon rods from acceleration belt conveyor 70 to lugged belt conveyor 80. This control system comprises a phase adjustment transmission, per se known, linking conveyors 72 and 83, sensors 90 and 91, and a suitably programmed general purpose computer or microprocessor. Sensors 90 and 91 may comprise photoelectric cells, or other sensing means known in the art, for example, suitably configured encoding wheels.

Sensor 90 is mounted on support plate 50 beneath the lower flight of acceleration belt conveyor 70. In one embodiment, sensor 90 includes five photoelectric cells arranged side-by-side in a row and aimed at the lower flight of belt 72. Sensor 91 comprises a single photoelectric cell mounted on support plate 50 beneath the lower flight of belt 83. Sensor 91 is aimed at the side of belt 83 to detect the presence of indentation lug notches 87, and accordingly, the position of the lugs of belt 83.

In operation, when a notch 87 in belt 83 passes by sensor 91, the sensor sends a timing signal to the computer. A second signal, generated by sensor 90 at the same time, represents whether some or all of the five photoelectric cells in sensor 90 have been triggered. These sensor signals are processed by the computer using conventional programming techniques, and results in an output signal being sent by the computer to the phaser transmission to increase, maintain, or decrease the relative speeds of belt conveyors 70 and 80.

For example, if a carbon rod engaged by belt 72 blocks the light path of all five of the photoelectric cells, the carbon rod is deemed to be adequately positioned on belt 72 for synchronized delivery to lugged belt conveyor 80. If one or more of the proximally located cells is uncovered, a lag exists between belt 72 and belt 83 and the phaser transmission is activated to decrease the speed of lugged belt conveyor 80. Conversely, if one or more distally located cells is triggered, than the phaser transmission is activated to increase the speed of lugged belt conveyor 80. In this manner the synchronization of acceleration belt conveyor 70 and lugged belt conveyor 80 is maintained to assure that the carbon rods are properly transferred between these conveyors. It is contemplated that a suitably configured encoding wheel could be used for sensor 90 to obtain greater resolution of the position of the carbon rods on belt 72.

Figure 6:
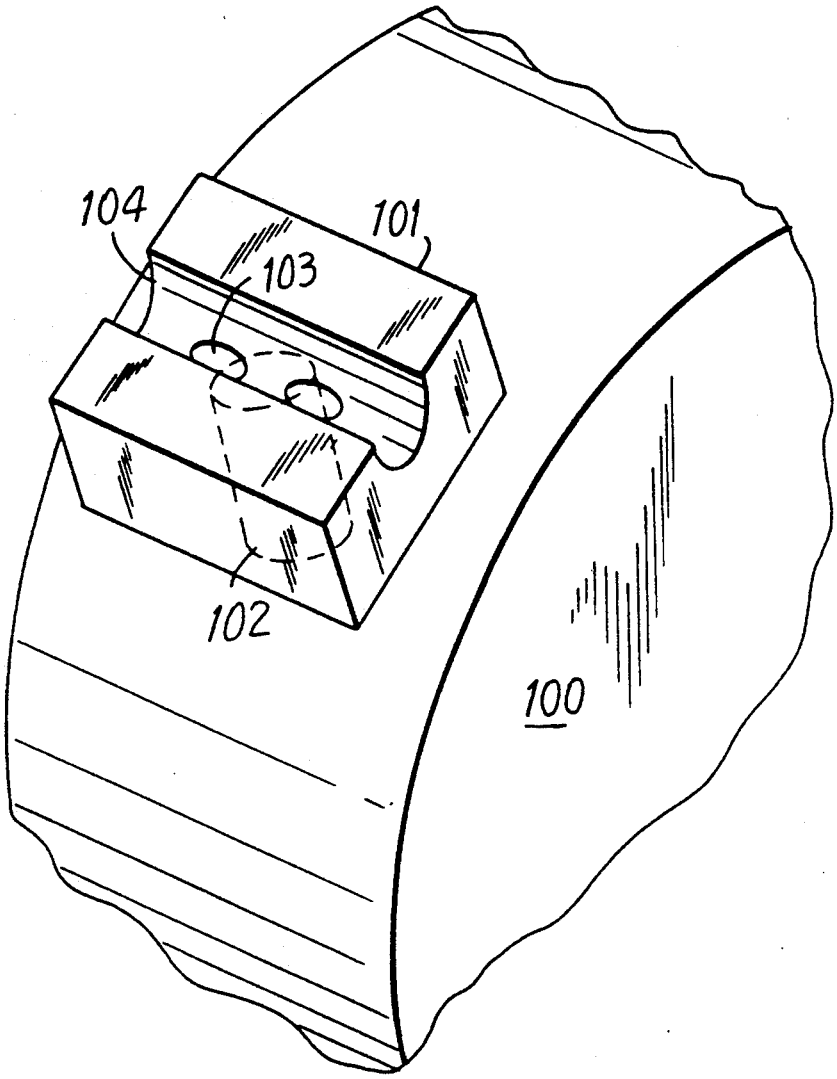
FIG. 6 is a fragmentary perspective view of a vacuum pocket of the first transfer drum, taken along the line 6—6 of FIG. 1.

Referring once again to FIG. 1, vacuum drum 100 is rotatably disposed from support plate 50 at a location above the distal end of the upper flight of lugged belt conveyor 80. Vacuum drum 100 has a plurality of vacuum pocket blocks 101 (of which one is shown) extending radially from its periphery and is synchronized to lugged belt conveyor 80 by mechanical linkage. As shown in FIG. 6, vacuum pocket blocks 101 are mounted on tubes 102 so that the blocks project radially from the periphery of drum 100. Each tube 102 supporting a block 101 is cammed to rotate through 90 degrees as it passes from a first position opposite the upper flight of lugged belt conveyor 80 to a second position nearest to transfer drum 110. Tube 102 has a passage to allow suction to be drawn through the apertures 103 in the carbon rod receiving groove 104 of block 101.

In operation, as a carbon rod carried in groove 84 of belt 83 passes beyond the distal end of suction enclosure 82, apertured groove 104 of vacuum pocket block 101 comes into close fitting relation with upper flight of belt 83, so that the carbon rod is released from the suction of lugged belt conveyor 80 and captured by the suction through the apertures 103 of vacuum pocket block 101. The mechanical linkage between belt conveyor 80 and vacuum drum 100 assures synchronization of vacuum pocket block 101 with the indentation lug 86 of belt 83 for transferring the carbon rod. As vacuum drum 100 continues to rotate in a clockwise direction, block 101 is cammed to rotate the carbon rod from a position wherein the longitudinal axis of the carbon rod is aligned with the direction of travel of lugged belt conveyor 80 to a position wherein its longitudinal axis is transverse the direction of belt travel.

Vacuum drum 100 continues to rotate in a clockwise direction until vacuum pocket block 101 is brought into close fitting relation with a vacuum-apertured flute of transfer drum 110. Transfer drum 110 rotates in a counterclockwise direction until its vacuum-apertured flute comes into close fitting relation with the vacuum-apertured assembly block 131 of assembly drum 120, at which point the carbon rod is transferred to assembly drum 120.

For the specific application of the sorting, transport and assembling system of the present invention for use in assembling smoking articles, the carbon rods transferred to assembly drum 120 are incorporated into a smoking article subassembly comprising a generator tube and an expansion tube, as described, for example, in the above-mentioned U.S. application Ser. No. 315,822. In one embodiment, these subassemblies are stored in a hopper 140 mounted on support plate 50. A feeder drum 150, rotatably mounted on support plate 50, engages the generator tube/expansion tube subassemblies from hopper 140 by suction means. The subassemblies are transferred to rotating vacuum-apertured transfer drum 160, similar in construction to transfer drum 110. From transfer drum 160, the smoking article subassemblies are transferred to assembly block 131 of assembly drum 120. Synchronization of the various drums is achieved by mechanical linkages, as is well known in the art.

Figure 7:
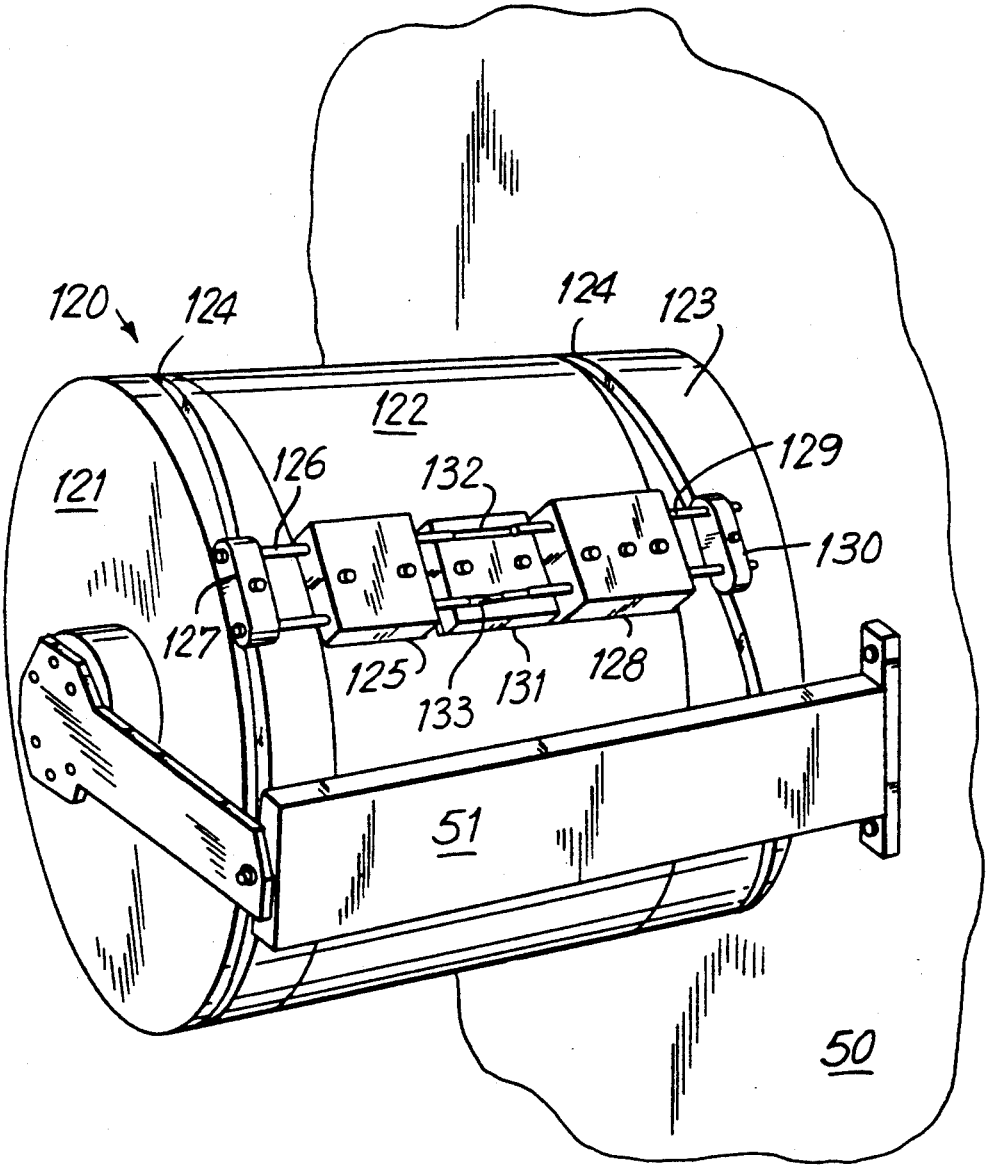
FIG. 7 is a fragmentary perspective view of the smoking article component assembly drum of the present invention, taken along the line 7—7 of FIG. 1.
Figure 8:
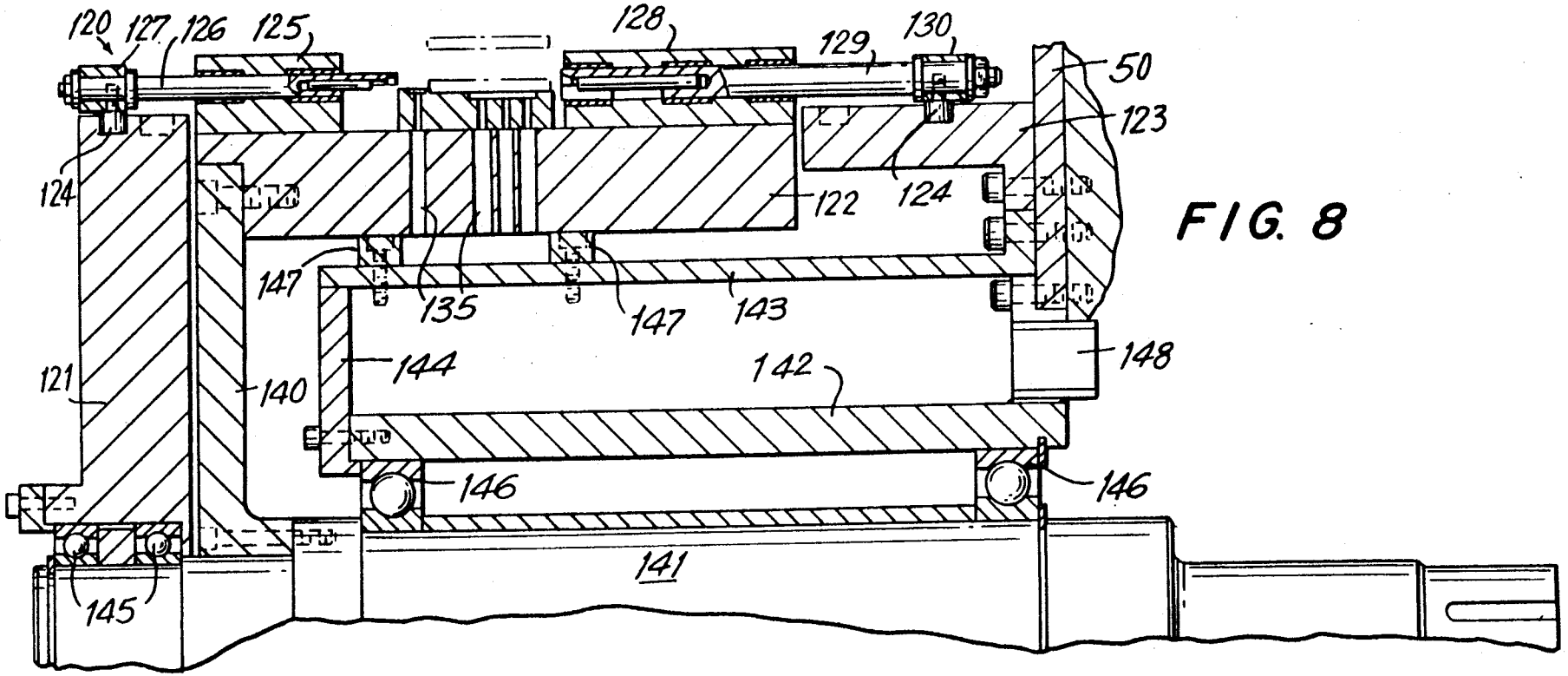
FIG. 8 is a longitudinal sectional view of the smoking article component assembly drum.

Referring to FIGS. 7 and 8, the structure and operation of smoking article component assembly drum 120 is described. Assembly drum 120 comprises outer and inner cam disks, 121 and 123 respectively, and assembly block support drum 122 rotatably mounted therebetween. Inner cam disk 123 is fixedly mounted to support plate 50. Outer cam disk 121 is fixedly mounted at one end of support bracket 51, which is in turn flanged to support plate 50. Each of cam disks 121 and 123 has an eccentric groove 124 in its lateral face.

The distal edge of assembly block support drum 122 is flanged to disk 140, which is in turn mounted on axle 141. Axle support barrel 142 is welded at its proximal edge to support plate 50. Assembly block support barrel 143, disposed concentrically about axle support barrel 142, is mounted at its proximal end to support plate 50. Member 144 is mounted to the distal ends of assembly block support barrel 143 and axle support barrel 142 to enhance the rigidity of the support barrels.

The proximal end of axle 141 rides in bearings 145 supported by support bracket 51, while the body of the axle rides in bearings 146 disposed near the proximal and distal ends of the annulus created between axle 141 and axle support barrel 142. Support rings 147 are fixed to the periphery of assembly block support barrel 143 to provide a bearing surface for the weight of assembly block support drum 122 which is disposed thereon. Suction fitting 148 is mounted to support plate 50 through an aperture in the support plate. Suction fitting 148 is connected to a conventional vacuum source for drawing suction in assembly block support drum 122. It is to be understood, of course, that the support structure comprising assembly block support barrel 143, member 144 and axle support barrel 142 has suitable openings therethrough for drawing a suction in assembly block support drum 122.

Figure 9:
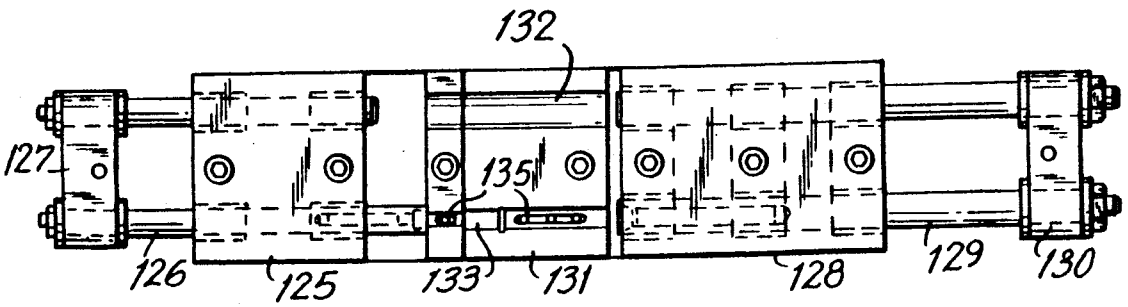
FIG. 9 is a top plan view of a smoking article component assembly block.

A plurality of assembly stations is carried on assembly block support drum 122, only one of which is shown in FIGS. 7 and 8. Each assembly station, shown in FIG. 9, is mounted on assembly block support drum 122 with its longitudinal axis oriented parallel to that of axle 141. Each assembly station comprises first slide block 125 having bars 126 disposed in bushings extending therethrough. The distal ends of bars 126 are mounted in stop block 127. Stop block 127 has a protrusion projecting from its lower surface which, due to the dimension of slide block 125, is constrained to extend into groove 124 in cam disk 121. Slide bars 126 therefore reciprocate through slide block 125 according to the eccentricity of groove 124 in cam disk 121. Second slide block 128 is similarly mounted so that the motion of its stop block 130 reflects the pattern of groove 124 in cam disk 123.

Assembly block 131 is disposed between slide blocks 125 and 128, and has two grooves 132, 133 across its top surface to accept the proximal and distal ends, respectively, of slide bars 126 and 129. Groove 133 has bores 135 extending through the thickness of assembly block 131 and assembly block support drum 122 for drawing a suction therethrough. During the transfer of a carbon rod from transfer drum 110 to assembly drum 120, the carbon rod is engaged by the apertured groove 133 of assembly block 131. Likewise, the generator tube/expansion tube subassembly is engaged by apertured groove 133 when it is transferred from transfer drum 160.

The proximal and distal ends, respectively, of slide bars 126 and 129 aligned with groove 133 have hollow first portions terminating in internal bearing surfaces. The hollow portions of slide bars 126 and 129 are designed so that the slide bar ends can pass over and restrain the carbon rod and smoking article subassembly residing in groove 133. In FIG. 8, a carbon rod is shown adjacent to the end of a generator tube/expansion tube subassembly, both items captured to groove 133 of assembly block 131 by suction drawn through bores 135. As stop blocks 127 and 130 follow grooves 124 of carbon disks 121 and 123, slides bars 126 and 129 are driven together. For a first part of this travel, the hollow ends of slide bars 126, 129 slide over the carbon rod and generator tube/expansion tube subassembly, respectively. Near the end of the stroke, the carbon rod and smoking article subassembly contact the internal bearing surfaces of the respective slide bars, thereby causing the carbon rod to be driven into the centrally located hole in the generator tube/expansion tube subassembly.

The above-described scheme for incorporating the carbon rod into the generator tube/expansion tube subassembly provides several advantages. First, the hollow portions of slide bars 126, 129 enclose the carbon rod and smoking article subassembly and prevent the parts from inadvertently scattering. Second, the scheme takes advantage of the axial compressive strength of the carbon rod by loading the carbon rod into the generator tube by compressive loading only. Third, the described method of loading the carbon rod permits some latitude in the generator tube inner diameter tolerancing, since the carbon rod can be focibly loaded into an undersized generator tube with no impact on the resulting product quality. Initial tests of the apparatus of the present invention indicate that assembling speeds of 2500 smoking articles per minute can be attained.

With reference to FIG. 1, it is to be understood, of course, that the apparatus may be reconfigured without departing from the inventive principles described heretofore. For example, isolation guideway 60 could be moved to the position shown by indicator "A", while braking belt conveyor 40 could be inverted and moved to the position shown by indicator "B." In this arrangement, carbon rods would exit from the distal end of covered belt conveyor 30 onto the proximal end of isolation guideway 60 and urge preceding carbon rods along isolation guideway 60 to its distal end at a speed comparable to that of the covered belt conveyor. Braking belt conveyor 40 would then grip the carbon rods from the distal end of isolation guideway 60. Acceleration belt conveyor 70, having its proximal end disposed over the distal end of braking belt conveyor 40, would grasp the carbon rods from belt 43 of braking belt conveyor 40. The balance of the transport and assembly would remain as previously described.

A feature of this alternate configuration, which may favor the use of the first-described embodiment, is that release and gripping points of braking belt conveyor 40 and acceleration belt conveyor 70 must be constructed with high precision. In particular, the apertures in suction housings 42 and 71 must be precisely positioned so that a carbon rod gripped by belt 43 of braking belt conveyor 40 is not simultaneously exposed to suction from both braking belt conveyor 40 and acceleration belt conveyor 70. In one embodiment of the present invention employing the alternative configuration of braking belt 40 and isolation guideway 60, such precise positioning of the transport system components and a more complex control system were employed to achieve satisfactory results.

In yet another application of the invention principles, the transport system of FIG. 1 may be reconfigured to eliminate isolation plate 60 entirely. In this embodiment, braking belt conveyor 40 is inverted and moved to the position shown by indicator "B," and the top flight of covered belt conveyor 30 is lowered parallel to the line of carbon rod travel by a distance approximately equal to the height of braking belt conveyor 40. In such an arrangement, the proximal end, lower flight of braking belt conveyor 40 would accept carbon rods from the distal end of covered belt conveyor 30 as in the first-described embodiment, and the distal end, upper flight of braking belt conveyor 40 would present he carbon rods to the proximal end of acceleration belt 70. While eliminating the use of isolation guideway 86 entirely, this arrangement may be subject to the same requirements as the last described alternate embodiment.

It is to be understood that while specific embodiments of the invention have been shown and described in detail to illustrate application of the inventive principles, the invention is not limited thereto but may otherwise be variously embodied within the scope of the following claims.

We claim:

1. The method of feeding cylindrical articles aligned end-to-end at uniform intervals comprising the steps of:

slidably engaging and accelerating a fluctuating stream of said articles with a convered belt conveyor;

engaging and decelertaing said fluctuating stream of said articles with a first suction belt conveyor to create a continuous stack of said articles, said articles in said stack advancing at the speed of said first suction belt conveyor; and engaging and accelerating said articles from said continuous stack of said articles with a second suction belt conveyor at a speed greater than the speed of said first suction belt conveyor, so as to provide a continuous, uniformly spaced stream of said articles.

2. The method of claim 1 further comprising the step of stripping said continuous, uniformly spaced stream of said articles from said second suction belt conveyor with a lugged suction belt conveyor, so as to better define the location of said articles.

3. The method of claim 2 further comprising the steps of sensing the location of the lugs of said lugged belt conveyor; sensing the location of said articles engaged by said second suction belt conveyor; and adjusting the relative speeds of said second suction belt conveyor and said lugged suction belt conveyor so as to synchronize said stripping step.

4. The method of feeding cylindrical articles aligned end-to-end at uniform intervals comprising the steps of:

slidably engaging and accelerating a fluctuating stream of said articles with a covered belt conveyor;

engaging and decelerating said fluctuating stream of said articles with a first suction belt conveyor to create a continuous stack of said articles, said articles in said stack advancing at the speed of said first suction belt conveyor;

engaging and accelerating said articles from said continuous stack of said articles with a second suction belt conveyor at a speed greater than the speed of said first suction belt conveyor, to provide a continuous, uniformly spaced stress of said articles;

monitoring said fluctuating stream of said articles with a first sensor means;

monitoring the length of said continuous stack of said articles created on said first suction belt conveyor; and adjusting said fluctuating stream of said articles so that said continuous stack of said articles does not exceed a target length.

5. The method of feeding cylindrical articles aligned end-to-end at uniform intervals comprising the steps of:

slidably engaging and accelerating a fluctuating stream of said articles with a covered belt conveyor;

engaging and decelerating said fluctuating stream of said articles with a first suction belt conveyor to create a continuous stack of said articles, said articles in said stack advancing at the speed of said first suction belt conveyor;

transferring said articles from said stack to an isolation guideway with said first suction belt conveyor; and engaging and accelerating said articles transferred to said isolation guideway with a second suction belt conveyor at a speed greater than the speed of said first suction belt conveyor, so as to provide a continuous, uniformly spaced stream of said articles.

6. The method of claim 5 further comprising the steps of:

monitoring said fluctuating stream of said articles with a first sensor means;

monitoring the length of said continuous stack of said articles created on said first suction belt conveyor; and adjusting said fluctuating stream of said articles so that said continuous stack of said articles does not exceed a target length.

7. The method of claim 5 further comprising the step of stripping said continuous, uniformly spaced stream of said articles from said second suction belt conveyor with a lugged suction belt conveyor, so as to better define the location of said articles.

8. The method of claim 7 further comprising the steps of sensing the location of the lugs of said lugged belt conveyor; sensing the location of said articles engaged by said second suction belt conveyor; and adjusting the relative speeds of said second suction belt conveyor and said lugged suction belt conveyor so as to synchronize said stripping step.

9. The method of feeding and assembling cylindrical articles into component assemblies comprising the steps of:

(a) depositing a jumbled mass of said articles into a bowl feeder having a mat and a sidewall;

(b) rotating said mat of said bowl feeder to centrifugally displace said articles against said sidewall so as to create a fluctuating stream, aligned end-to-end, of said articles;

(c) directing said fluctuating stream of said articles onto a covered belt conveyor;

(d) slidably engaging and accelerating said fluctuating stream of said articles with a covered belt conveyor;

(e) engaging and decelerating said fluctuating stream of said articles with a first suction belt conveyor to create a continuous stack of said articles, said articles in said stack advancing at the speed of said first suction belt conveyor;

(f) engaging and accelerating said articles from said continuous stack of said articles with a second suction belt conveyor at a speed greater than the speed of said first suction belt conveyor, so as to provide a continuous uniformly spaced stream of said articles;

(g) stripping said continuous uniformly spaced stream of said articles from said second suction belt conveyor with a lugged suction belt conveyor, so as to better define the location of said articles in said continuous uniformly spaced stream of said articles;

(h) transferring said continuous uniformly spaced stream of said articles through a plurality of vacuum transfer drums; and (i) assembling each of said articles in said continuous uniformly spaced stream of said articles into a component assembly.

10. The method of claim 9 further comprising the step of transferring said fluctuating stream of said articles to an isolation guideway between step (d) and step (e).

11. The method of claim 9 further comprising the step of transferring said continuous stack of said articles to an isolation guideway between step (e) and step (f).

12. The method of claim 9 further comprising the steps of sensing the location of the lugs of said lugged belt conveyor; sensing the location of said articles engaged by said second suction belt conveyor; and adjusting the relative speeds of said second suction belt conveyor and said lugged suction belt conveyor so as to synchronize step (g).

13. The method of claim 9 wherein each of said articles is rotated from a first position wherein the longitudinal axis of said article is aligned with the direction of travel of said lugged belt conveyor to a second position wherein the longitudinal axis of said article is transverse the direction of travel of said lugged belt conveyor during step (h).

14. An apparatus for feeding cylindrical articles aligned end-to-end at uniform intervals comprising:

a support structure including a support plate, a covered belt conveyor, mounted on said support structure, for slidably engaging and accelerating a fluctuating stream of said articles;

a first suction belt conveyor, mounted on said support plate, for engaging said fluctuating stream of said articles to create a continuous stack of said articles, said articles in said stack advancing at the speed of said first suction belt conveyor;

first drive means for driving said first suction belt conveyor at a speed lower than the speed of said covered belt conveyor, so that articles accepted by said first suction belt conveyor are decelerated;

a second suction belt conveyor, mounted on said support plate, for engaging each of said articles from said continuous stack of said articles; and second drive means for driving said second suction belt conveyor at a speed greater than the speed of said first suction belt conveyor, so that articles engaged by said second suction belt conveyor are accelerated to provide a continuous, uniformly spaced stream of said articles.

15. The apparatus of claim 14 further comprising an isolation guideway mounted on said support plate for receiving said continuous stack of said articles from said first suction belt conveyor.

16. The apparatus of claim 14 further comprising a lugged suction belt conveyor, mounted on said support plate, for stripping said continuous, uniformly spaced stream of said articles from said second suction belt conveyor, so as to better define the location of said articles.

17. The apparatus of claim 14 further comprising:

a first sensor mounted on said support plate adjacent to said lugged suction belt conveyor for outputting a first signal indicating the position of the lugs of said lugged suction conveyor belt;

a second sensor mounted on said support plate adjacent to said second suction belt conveyor for outputting a second signal indicating the location of said articles engaged by said second suction belt conveyor;

a phaser transmission linking said lugged suction belt conveyor and said second suction belt conveyor, said phaser transmission responsive to a synchronizing signal; and a microprocessor programmed to receive and process said first signal and second signals, and to generate and send a synchronizing signal to said phaser transmission, so that the operation of said lugged suction belt conveyor and said second suction belt conveyor is synchronized.

18. The apparatus of claim 14 further comprising a bowl feeder for centrifugally sorting a jumbled mass of cylindrical articles deposited within it to produce a fluctuating stream of end-to-end aligned articles, which fluctuating stream of end-to-end aligned articles is input to said covered belt conveyor.

19. The apparatus of claim 18 further comprising:

a third sensor for outputting a third signal indicating the density of said cylindrical articles deposited within said bowl feeder;

a fourth sensor for outputting a signal indicating that the length of said continuous stack of said articles created on said covered belt conveyor exceeds a target length;

adjusting means for adjusting said density of said cylindrical articles deposited within said bowl feeder, said means responsive to an adjusting signal; and means for receiving said third and fourth signals, and for sending an adjusting signal to said adjusting means, so that said continuous stack of said articles on said covered belt conveyor does not exceed a target length.

20. An apparatus for feeding and assembling cylindrical articles into component assemblies, said apparatus comprising:

a bowl feeder for centrifugally sorting a jumbled mass of cylindrical articles deposited within it to produce a fluctuating stream of end-to-end aligned cylindrical articles.

a support structure including a support plate, a covered belt conveyor, mounted on said support structure, for slidably engaging and accelerating said fluctuating stream of end-to-end aligned cylindrical articles received from said bowl feeder;

a first suction belt conveyor, mounted on said support plate, for engaging and decelerating said fluctuating stream of end-to-end aligned cylindrical articles to create a continuous stack of said articles, said articles in said stack advancing at the speed of said first suction belt conveyor;

a second suction belt conveyor, mounted on said support plate, for engaging and accelerating each of said cylindrical articles from said continuous stack of said articles at a speed greater than the speed of said first suction belt conveyor, so as to provide a continuous stream of uniformly spaced cylindrical articles;

a lugged suction belt conveyor, mounted on said support plate, for stripping said continuous stream of uniformly spaced cylindrical articles from said second suction belt conveyor, so as to better define the location of said cylindrical articles;

an assembly drum rotatably mounted on said support plate for assembling each of said cylindrical articles in said continuous stream of uniformly spaced cylindrical articles into a component assembly; and a plurality of vacuum transfer drums rotatably mounted on said support plate for transferring said continuous stream of uniformly spaced cylindrical articles from said lugged suction belt conveyor to said assembly drum.

21. The apparatus of claim 20 further comprising an isolation guideway mounted on said support plate for receiving said continuous stack of said articles from said first suction belt conveyor.

22. The apparatus of claim 20 further comprising:

a first sensor mounted on said support plate adjacent to said lugged suction belt conveyor for outputting a first signal indicating the position of the lugs of said lugged suction conveyor belt;

a second sensor mounted on said support plate adjacent to said second suction belt conveyor for outputting a second signal indicating the location of said cylindrical articles engaged by said second suction belt conveyor;

a phaser transmission linking said lugged suction belt conveyor and said second suction belt conveyor, said phaser transmission responsive to a synchronizing signal; and a microprocessor programmed to receive and process said first signal and second signals, and to generate and send a synchronizing signal to said phaser transmission, so that the operation of said lugged suction belt conveyor and said second suction belt conveyor is synchronized.

23. The apparatus of claim 20 further comprising:

a third sensor for outputting a third signal indicating the density of said cylindrical articles deposited within said bowl feeder;

a fourth sensor for outputting a signal indicating that the length of said continuous stack of said cylindrical articles created on said covered belt conveyor exceeds a target length;

adjusting means for adjusting said density of said cylindrical articles deposited within said bowl feeder, said means responsive to an adjusting signal; and means for receiving said third and fourth signals, and for sending an adjusting signal to said adjusting means, so that said continuous stack of said cylindrical articles on said covered belt conveyor does not exceed a target length.

24. The apparatus of claim 20 wherein said assembly drum comprises:

first and second cam disks rigidly mounted to said support plate;

an assembly block support drum rotatably mounted between said first and second cam disks; and, a plurality of assembly stations mounted on said assembly block support drum, said assembly stations having first and second means for engaging said first and second cam disks, respectively, to actuate said assembly station.

25. The apparatus of claim 24 wherein each of said plurality of assembly stations comprises:

a first slide block having a first pair of bores, said first slide block mounted near the distal edge o said assembly block support drum;

a first pair of slide bars having proximal and distal ends, said first pair of slide bars slidably disposed in said first pair of bores;

a first stop block mounted on said distal ends of said first pair of slide bars, said first stop block having said first means for engaging said first cam disk mounted thereon;

a second slide block having a second pair of bores, said second slide block mounted near the proximal edge of said assembly support drum;

a second pair of slide bars having proximal and distal ends, said second pair of slide bars slidably disposed in said second pair of bores, said distal ends of said second pair of slide bars positioned in opposing relation to said proximal ends of said first pair of slide bars; and a second stop block mounted on said proximal ends of said second pair of slide bars, said second slide block having said second means for engaging said second cam disk mounted thereon, so that when said assembly support block drum rotates between said first and second cam disks, said proximal ends of said first pair of slide bars and said distal ends of said second pair of slide bars are actuated to assemble one of said cylindrical articles in said continuous stream of uniformly spaced cylindrical articles into a component assembly.

26. The apparatus of claim 20 wherein at least one of said plurality of vacuum transfer drums has a plurality of vacuum pocket blocks, each of said vacuum pocket blocks which rotates from a first position wherein the longitudinal axis of each of said cylindrical articles in said continuous stream of uniformly spaced cylindrical articles is aligned with the direction of travel of said lugged belt conveyor to a second position wherein the longitudinal axis of each of said cylindrical articles in said continuous stream of uniformly spaced cylindrical articles is transverse the direction of travel of said lugged belt conveyor.

* * * * *